United States Patent [19]

Kanbe et al.

[11] Patent Number: 4,473,627

[45] Date of Patent: Sep. 25, 1984

[54] DEVELOPING METHOD FOR DEVELOPER TRANSFER UNDER ELECTRICAL BIAS AND APPARATUS THEREFOR

[75] Inventors: Junichiro Kanbe, Tokyo; Tsutomu Toyono, Ohizumi; Nagao Hosono, Chofu; Tohru Takahashi, Tokyo, all of Japan

[73] Assignee: Canon Kabushiki Kaisha, Tokyo, Japan

[21] Appl. No.: 426,979

[22] Filed: Sep. 29, 1982

Related U.S. Application Data

[63] Continuation of Ser. No. 223,900, Jan. 9, 1981, abandoned, which is a continuation-in-part of Ser. No. 58,434, Jul. 18, 1979, abandoned, and a continuation-in-part of Ser. No. 58,435, Jul. 18, 1979, Pat. No. 4,292,387.

[30] Foreign Application Priority Data

| | | | |
|---|---|---|---|
| Jul. 28, 1978 | [JP] | Japan | 53-92105 |
| Jul. 28, 1978 | [JP] | Japan | 53-92106 |
| Jul. 28, 1978 | [JP] | Japan | 53-92107 |
| Jul. 28, 1978 | [JP] | Japan | 53-92108 |
| Apr. 28, 1979 | [JP] | Japan | 54-52641 |
| Apr. 28, 1979 | [JP] | Japan | 54-52640 |
| Jun. 1, 1979 | [JP] | Japan | 54-68564 |
| Jun. 1, 1979 | [JP] | Japan | 54-68564 |
| Jan. 14, 1980 | [JP] | Japan | 55-3247 |

[51] Int. Cl.[3] ..... G03G 13/09; G03G 15/09

[52] U.S. Cl. ..... 430/102; 430/103; 430/122; 118/653; 118/657

[58] Field of Search ..... 430/102, 103, 903, 122; 118/653, 657; 355/3 DD

[56] References Cited

U.S. PATENT DOCUMENTS

| | | | |
|---|---|---|---|
| 3,346,475 | 10/1967 | Matkan et al. | 430/103 |
| 3,866,574 | 2/1975 | Hardennrook et al. | 355/3 DDX |
| 3,890,929 | 6/1975 | Walkup | 355/3 DDX |
| 3,893,418 | 7/1975 | Liebman et al. | 355/3 DDX |
| 3,918,966 | 11/1975 | Metcalfe et al. | 430/103 |
| 4,292,387 | 9/1981 | Kanbe et al. | 430/102 |

*Primary Examiner*—Roland E. Martin

*Attorney, Agent, or Firm*—Fitzpatrick, Cella, Harper & Scinto

[57] ABSTRACT

This specification discloses a method of toner transfer development in which a low frequency alternating electrical bias is applied to the space between a latent image bearing member and a developer carrying member to develop the latent image on the latent image bearing member, and an apparatus for carrying out the same method. This bias has a first stage in which one-sided movement of developer particles from the developer carrying member to the image area of the latent image bearing member may take place, a second stage in which reciprocal movement of developer particles is effected between both the image and non-image areas of the latent image bearing member and the developer carrying member, and a third stage in which the intensity of the bias is reduced so that one-sided movement of developer particles from the developer carrying member to the image area and one-sided movement of developer particles from the non-image area to the developer carrying member may take place.

13 Claims, 15 Drawing Figures

DEVELOPING METHOD FOR DEVELOPER TRANSFER UNDER ELECTRICAL BIAS AND APPARATUS THEREFOR

This is a continuation of application Ser. No. 223,900, filed Jan. 9, 1981, now abandoned, which is a continuation-in-part of original application No. 58,434 filed July 18, 1979 abandoned, and a continuation in part of original application No. 58,435 filed July 18, 1979 U.S. Pat. No. 4,292,387.

BACKGROUND OF THE INVENTION

1. Field of the Invention

This invention relates to a developing method for developing a latent image by the use of a developer and an apparatus therefore, and more particularly to a developing method using a one-component developer, especially a developing method which enables realization of fogless visible images excellent in sharpness and gradation or tone reproduction, and an apparatus therefor.

2. Description of the Prior Art

Various types of developing methods using a one-component developer are heretofore known such as the power cloud method which uses toner particles in cloud condition, the contact developing method in which a uniform toner layer formed on a toner supporting member comprising a web or a sheet is brought into contact with an electrostatic image bearing surface to effect development, and the magnedry method which uses a conductive magnetic toner formed into a magnetic brush which is brought into contact with the electrostatic image bearing surface to effect development.

Among the above-described various developing methods using one-component developer, the power cloud method, the contact developing method and the magnedry method are such that the toner contacts both the image area (the area to which the toner should adhere) and the non-image area (the background area to which the toner should not adhere) and therefore, the toner more or less adheres to the non-image area as well, thus unavoidably creating the so-called fog or bacground toner deposition.

To avoid such fog, there has been proposed the transfer development with a space between a toner donor and an image bearing member in which a toner layer and an electrostatic image bearing surface are disposed in opposed relationship with a clearance therebetween in a developing process so that the toner is caused to fly to the image area by the electrostatic field thereof and the toner does not contact the non-image area. Such development is disclosed, for example, in U.S. Pat. Nos. 2,803,177; 2,758,525; 2,838,997; 2,839,400; 2,862,816; 2,996,400; 3,232,190 and 3,703,157. This development is a highly effective method in preventing the fog. Nevertheless, the visible image obtained by this method generally suffers from the following disadvantages because it utilizes the flight of the toner resulting from the electric field of the electrostatic image during the development.

A first disadvantage is the problem that the sharpness of the image is reduced at the edges of the image. The state of the electric field of the electrostatic image at the edge thereof is such that if an electrically conductive member is used as the developer supporting member, the electric lines of force which emanate from the image area reach the toner supporting member so that the toner particles fly along these electric lines of force and adhere to the surface of the photosensitive medium, thus effecting development in the vicinity of the center of the image area. At the edges of the image area, however, the electric lines of force do not reach the toner supporting member due to the charge induced at the non-image area and therefore, the adherence of the flying toner particles is very unreliable and some of such toner particles barely adhere while some of the toner particles do not adhere. Thus, the resultant image is an unclear one lacking sharpness at the edges of the image area, and line images, when developed, give an impression of having become thinner than the original lines.

To avoid this in the above-described toner transfer development, the clearance between the electrostatic image bearing surface and the developer supporting member surface must be sufficiently small (e.g. smaller than 100$\mu$) and actually, accidents such as pressure contact of the developer and mixed foreign substances are liable to occur between the two surfaces. Also, maintaining such a fine clearance often involves difficulties in designing of the apparatus.

A second problem is that images obtained by the above-described toner transfer development usually lack toner reproducibility. In the toner transfer development, the toner does not fly until the toner overcomes the binding power to the toner supporting member by the electric field of the electrostatic image. This power which binds the toner to the toner supporting member is the resultant force of the Van der Waals force between the toner and the toner supporting member, the force of adherence among the toner particles, and the reflection force between the toner and the toner supporting member resulting from the toner being charged. Therefore, flight of the toner takes place only when the potential of the electrostatic image has become greater than a predetermined value (hereinafter referred to as the transition threshold value of the toner) and the electric field resulting therefrom has exceeded the aforementioned binding force of the toner, whereby adherence of the toner to the electrostatic image bearing surface takes place. But the binding power of the toner to the supporting member differs in value from particle to particle or by the particle diameter of the toner even if the toner has been manufactured or prepared in accordance with a predetermined prescription, however, it is considered to be distributed narrowly around a substantially constant value and correspondingly, the threshold value of the electrostatic image surface potential at which the flight of toner takes place also seems to be distributed narrowly around a certain constant value. Such presence of the threshold value during the flight of the toner from the supporting member causes adherence of the toner to that part of the image area which has a surface potential exceeding such threshold value, but causes little or no toner to adhere to that part of the image area which has a surface potential lower than the threshold value, with a result that there are only provided images which lack the toner gradation having steep $\gamma$ (the gradient of the characteristic curve of the image density with respect to the electrostatic image potential).

In view of such problems, a developing device in which a pulse bias of very high frequency is introduced across an air gap to ensure movement of charged toner particles flying through the air gap, whereby the charged toner particles are made more readily available to the charged image is disclosed in U.S. Pat. Nos. 3,866,574; 3,890,292 and 3,893,418.

Such high frequency pulse bias developing device may be said to be a developing system suitable for line copying in that a pulse bias of several KHz or higher is applied in the clearance between the toner donor member and the image retaining member to improve the vibratory characteristic of the toner and prevent the toner from reaching the non-image area in any pulse bias phase but cause the toner to transit only to the image area, thereby preventing fogging of the non-image area. However, the aforementioned U.S. Pat. No. 3,893,418 states that a very high frequency (18 KHz–22 KHz) is used for the applied pulse voltage in order to make the device suitable for the reproduction of tone gradation of the image.

U.S. Pat. No. 3,346,475 discloses a method which comprises immersing two electrodes in insulating liquid contained in a dielectrophoretic cell and applying thereto an AC voltage of very low frequency (lower than about 6 Hz) to thereby effect the development of a pattern corresponding to the conductivity variance.

Further, U.S. Pat. No. 4,014,291 discloses a transfer development which uses dry one-component magnetic toner, but this patent does not suggest that a bias is applied for the above-described purpose of preventing fog.

The toner transfer development utilizing an alternating current bias is disclosed in U.S. patent applications Ser. Nos. 58,434 and 58,435 which are the parent applications of the subject application. The present invention is concerned with an improvement in the principle disclosed in the above parent applications.

SUMMARY OF THE INVENTION

The present invention has been made to eliminate the above-noted problems peculiar to the various developing methods using one-component developer, and it is a primary object of the invention to provide a developing method which enables realization of visible images which are free of fog or background toner deposition and far more excellent in edge reproduction and tone gradation, and an apparatus therefore.

It is another object of the present invention to provide a developing method based on the principle of development in which a low frequency alternate or alternating electric field having a phase of a particular polarity which causes the developer to one-sidedly reach both the image area and the non-image area of a latent image bearing member from a developer carrier and a phase of the opposite polarity to the particular polarity which applies a bias in a direction to cause the developer having reached at least the non-image area to return to the developer carrier side, is applied in the developing clearance to thereby ensure transition of the developer to the non-image area and back transition of the developer to the developer carrier to be alternately repeated even in the clearance between the developer carrier and the non-image area in the developing station and enable a development very excellent in tone reproduction to be accomplished by such reciprocal movement of the developer, and an apparatus therefore.

It is still another object of the present invention to provide a developing method which has a first stage in which one-sided movement of developer particles from the developer carrying member to the image area of the latent image bearing member may take place, a second stage in which reciprocal movement of developer particles is effected between both the image and non-image areas of the latent image bearing member and the developer carrying member, and a third stage in which the intensity of the bias is reduced so that one-sided movement of developer particles from the developer carrying member to the image area and one-sided movement of developer particles from the non-image area to the developer carrying member may take place, thereby obtaining a result of development which is free of fog and excellent in tone gradation, and an apparatus therefor.

It is a further object of the present invention to provide a developing method in which the extraneously applied vibratory alternate voltage is maintained constant and the latent image bearing member and the developer carrier are opposed to each other while being moved to decrease and then increase the clearance therebetween gradually, to thereby inpart the first, second and third stages, and an apparatus therefor.

It is a further object of the present invention to provide a developing method which comprises disposing a latent image bearing member and a developer carrier carrying a developer layer thereon in opposed relationship in a developing station with a clearance maintained therebetween, the minimum clearance being greater than the thickness of the developer layer, and effecting development while applying an alternate electric field in a range satisfying $$40\ \text{Hz} \leqq f \leqq 1.5\ \text{KHz}$$

where $V_{p\text{-}p}$ represents the amplitude of the alternate electric field (V: peak-to-peak value) and f represents the alternating frequency of the alternate electric field, to apply an alternate electric field having a phase of a particular polarity which causes the developer to one-sidedly reach both the image area and the non-image area of the latent image bearing member from the developer carrier in the developing clearance and a phase of the opposite polarity to the particular polarity for applying a bias in a direction to cause the developer having reached at least the non-image area to return to the developer carrier side, and an apparatus therefore.

It is a further object of the present invention to provide a developing method which comprises disposing a latent image bearing member and a developer carrier in opposed relationship in a developing station with a clearance maintained therebetween, and effecting development by applying to the clearance an alternate voltage of a frequency preferably lower than 1.5 KHz, the frequency and amplitude value of the alternate voltage being selectively changed over in accordance with the kind of the image to be reproduced, and an apparatus therefore.

Other objects and features of the present invention will become apparent from the following detailed description of some embodiments of the invention taken in conjunction with the accompanying drawings.

DESCRIPTION OF THE PREFERRED EMBODIMENTS

Figure 1:
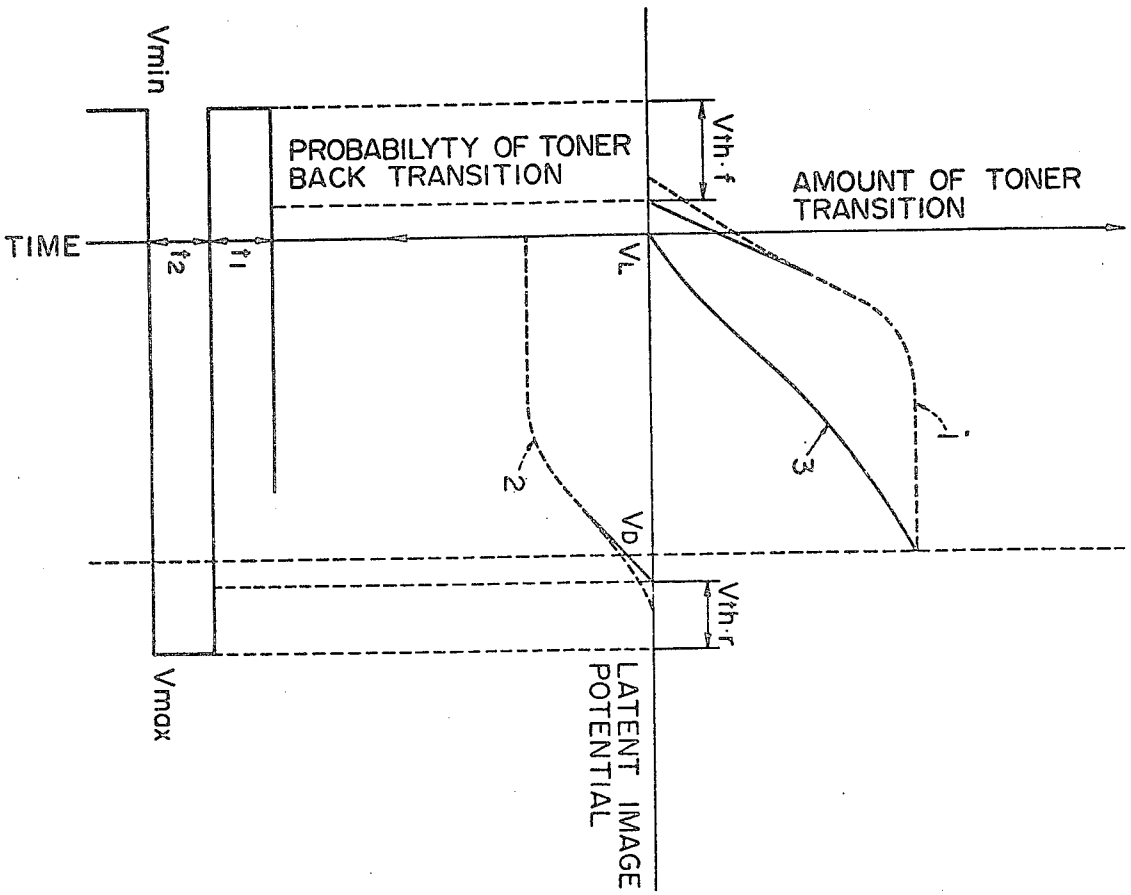
FIG. 1 illustrates the amount of transition of the toner and the characteristic of the degree of toner back transition for the potential of a latent image, as well as an example of the voltage waveform applied.

Reference is first had to FIG. 1 to described the principle of fog prevention and enhanced tone reproduction of visualized image which may be expressed as the objects and effects of the present invention.

FIG. 1 is a graph in which the abscissa represents the electrostatic image potential and the ordinate represents the amount of transition of toner from a developer carrier (thereinafter also referred to as the toner carrier) to an electrostatic image bearing surface (positive direction) or the degree of back transition of toner which means that the toner having adhered to the electrostatic image bearing surface is stripped off therefrom (the degree of transition in the negative direction will hereinafter be described). The electrostatic image potential is represented with the non-image area potential $V_L$ (which is usually the potential of the surface in a region corresponding to the light portion of an image and has a minimum value as the potential) and the image area potential (which is usually the potential of the surface in a region corresponding to the dark portion of the image and has a maximum value as the potential) as the potentials at the ends. The surface potential of the half-tone region of the image including half-tone assumes a potential intermediate $V_D$ and $V_L$ due to the degree of that tone.

In the lower portion of FIG. 1, the voltage waveform applied to the toner carrier is depicted with the abscissa representing the potential and with the ordinate representing the time. A rectangular wave is exemplarily shown there, whereas waveform is not restricted to such waveform. The rectangular wave shown exemplarily is such a periodical alternating waveform that the minimum voltage $V_{min}$ of the toner carrier with the back electrode of the electrostatic image bearing member as the standard is applied in a time interval $t_1$ and the bias voltage of the maximum voltage $V_{max}$ is applied in a time interval $t_2$.

The image area potential $V_D$ assumes a positive potential in some cases and assumes a negative potential in other cases, depending on the electrostatic image formation process used, and this also holds true with the non-image area potential $V_L$. Herein, however, to make the invention more easily understood, description will be made with respect to the case where $V_D$ is a positive potential. Of course, this is only for the purpose of illustration and the invention is not restricted thereto. When $V_D>0$, the relation between $V_D$ and the non-image area potential $V_L$ becomes $V_D>V_L$. Now, if the relation between the maximum voltage $V_{max}$ and the minimum voltage $V_{min}$ applied to the toner carrier and $V_L$ is set to satisfy $$V_{max}>V_L>V_{min} \quad (1),$$

the bias voltage $V_{min}$ acts to cause toner particles to transit from the toner carrier toward the electrostatic image bearing member at the time interval $t_1$ and therefore, this stage is called the toner transition stage. At the time interval $t_2$, the bias voltage $V_{max}$ acts with a tendency to cause the toner which has transited to the electrostatic image bearing member in the time interval $t_1$ to be returned to the toner carrier and therefore this stage is called the toner back transition stage.

In the upper portion of FIG. 1, the amount of toner transition at $t_1$ and the degree of toner back transition at $t_2$ are plotted with respect to the electrostatic image potential. Here, the term "degree of toner back transition" is used to represent the probability of the toner back transition which takes place from the electrostatic image bearing member back to the toner carrier if the bias boltage $V_{max}$ is applied in a supposed case that toner as a uniform layer adheres to both the image area and the non-image area of the electrostatic image bearing member.

Now, the amount of toner transition from the toner carrier to the electrostatic image bearing member in the toner transition stage is such as indicated by curve 1 shown by broken line in FIG. 1. The gradient of this curve is substantially equal to the gradient of the curve obtained when no bias alternate voltage is applied. This gradient is great and the amount of the toner transition tends to be saturated at a value intermediate $V_L$ and $V_D$ and accordingly, it is not suited for the reproduction of half-tone images and provides poor tone gradation. Curve 2 indicated by another broken line in FIG. 1 represents the afore-mentioned probability of the toner back transition in the toner back transition stage.

In the developing method according to the present invention, an alternating electric field is imparted so that such toner transition stage and toner back transition stage are alternately repeated, and, in the bias phase ($t_1$) of the toner transition stage of the alternating electric field, toner is caused to once reach even the non-image area of the electrostatic image bearing member (of course, the toner is caused to reach the image area as well), and the toner is also caused to sufficiently adhere to the half-tone potential portion having a low potential approximate to the light region potential ($V_L$) to thereby enhance the tone reproduction. Before that stage, the bias is so adjusted as to produce one-sided movement of developer particles from the developer carrying member to the image area of the latent image bearing member. And after the toner reciprocal movement staged above in the bias phase ($t_2$) of the toner back transition stage, the bias is caused to act in the direction opposite to the direction of toner transition to thereby cause the toner having reached the non-image area to be returned to the toner carrier. In this toner back transition stage, as will hereinafter the described, the toner having reached the non-image area as described tends to return to the toner carrier from the non-image area as soon as the bias field of the oppsite polarity is applied, because the non-image area originally have no image potential. On the other hand, since the toner having once adhered to the image area including the half-tone area is attracted to the image area charge, little amount of toner actually returns to the toner carrier from the image area even if the reverse bias is applied in the direction opposite to this attraction. By so causing the bias fields of the opposite polarities to alternate at a preferable amplitude and frequency, the toner transition and back transition may be repeated a number of times at the developing station. Thus, the amount of the toner transiting to the latent image surface may be rendered, to an amount of transition faithful to the potential of the electrostatic image. That is, it is possible to provide a developing action which may result in a variation in amount of toner transition having a small gradient and substantially uniform from the potential $V_L$ to $V_D$ as shown by curve 3 in FIG. 1. Accordingly, practically no toner adheres to the non-image area while, on the other hand, the adherence of the toner to the half-tone image areas is so good that there is provided an excellent visible image having a very good tone reproduction corresponding to the surface potential thereof. This tendency may be made more pronounced by setting the clearance between the electrostatic image bearing member and the toner carrier so that it is greater toward the end of the developing process and by decreasing and converging the intensity of the above-described field in the developing clearance.

As a method of adjusting the intensity of such electric field in the developing clearance, there is a first method of gradually converging the applied alternate voltage to a suitable predetermined DC value, and a second method of increasing the developing clearance itself with the developing time. These two methods will hereinafter be described respectively.

Figure 2A:
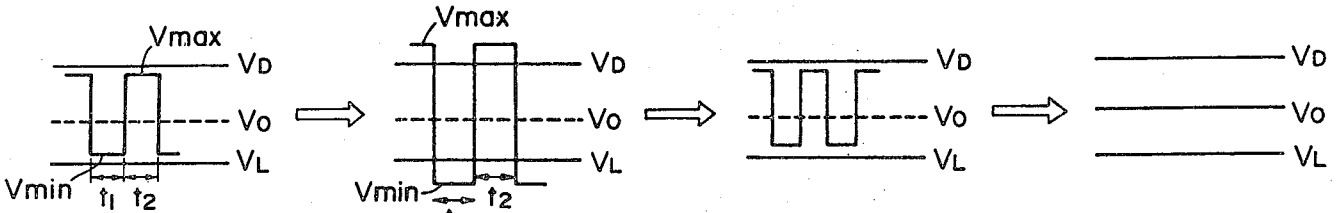
FIGS. 2A–2C illustrate the developing process of the developing method according to the present invention.
Figure 2B:
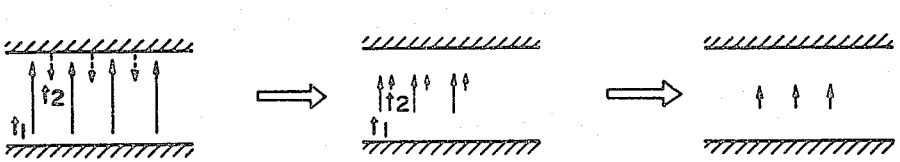
Figure 2C:
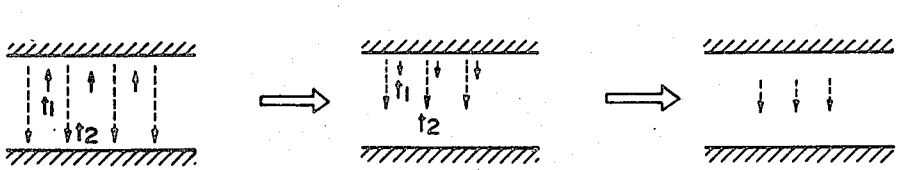

The developing process in the first method is shown in FIGS. 2A–2C.

FIG. 2A shown, in order of (1), (2), (3) and (4) stages, the variation with time in an example of the waveform of the applied alternate voltage in the case of the above-mentioned first method. Of course, both of continuous variation and intermittent variation are possible, and in the case of continuous variation, the stage (2) in the shown example shows the intermediate stage of the variation.

FIGS. 2B and 2C exemplarily show the manner of toner transition and toner back transition in the image area and the non-image area of the electrostatic image bearing member, with the variation in the developing time stages (1), (2) and (3). In these figures, the direction of solid-line arrows shows the electric field in the toner transition direction, and the length of the arrows represents the intensity of the electric field. Broken line arrows shown the electric field in the toner back transition direction and the lenght thereof represents the intensity of the electric field.

In FIGS. 2A–2C, the initial process (1) is called a first stage, and the process (2) constituting an intermediate stage (which will later be described in greater detail) is called a second stage. (3) designates a third stage to the termination of the development whereat the alternation of the applied voltage is reduced. And at a final stage (4) the voltage is converged to an appropriate predetermined DC value ($V_O$) intermediate $V_D$ and $V_L$.

It is important that the action of the opposite polarity to the toner transition in the image area and the non-image area in the first, the second and the third stages is varied. This status will be described phenomonologically. First, in the image area, as exemplarily shown in FIG. 2A, a predetermined bias voltage relation is set so that, as shown in FIG. 2B, one sided movement of developer particles takes plase from the developer carrying member to the image area of the latent image bearing member. Although in the non-image area, as shown in FIG. 2C, toner backward electric potential is established, there is no actual toner backward transition since no toner is deposited prior to this first stage.

In the second stage, applied bias is adjusted to achieve the predetermined bias voltage relations described hereinafter. Thus in the time period $t_1$ (applied voltage is $V_{min}$), a relatively strong toner transition field occurs from the toner carrier toward the image area of the electrostatic image bearing member and toner reaches and adheres to the image area. On the other hand, in the time period $t_2$ (applied voltage is $V_{max}$), a relatively weak toner back transition field occurs toward the electrostatic image bearing member and part of the toner is returned from the image area to the toner carrier. Each time the time periods $t_1$ and $t_2$ are so repeated, the toner transition and back transition occur between the toner carrier and the non-image area. Since the relation between the applied voltages $V_{min}$ and $V_{max}$ and the image area potential $V_D$ is set to $$|V_{max}-V_D|<|V_D-V_{min}| \quad (2),$$

the amount of toner transition from the toner carrier to the image area is much greater than the amount of toner back transition in the first process and therefore, it practically offers no problem that the toner back transition reduces the toner transition, namely, the effect of development.

Subsequently, when the amplitude of the applied voltage is continuously or intermittently attenuated to a predetermined value of $$V_{max}=V_D+|V_{th\cdot r}| \quad (3)$$

as shown by (3) in FIG. 2A, the amount of back transition of the toner to the toner carrier from the electrostatic image bearing member to which the toner have once adhered in the time period $t_2$ becomes substantially zero. $|V_{th\cdot r}|$ is the minimum absolute potential difference between the electrostatic image formation surface and the toner carrier surface at which the toner can be separated from the electrostatic image formation surface and can effect back transition to the toner carrier.

Further, when $$V_{max}<V_D+|V_{th\cdot r}| \quad (4)$$

is reached, the back transition occurs no longer and instead, there is produced an electric field which expedites the toner transition from the toner carrier to the electrostatic image bearing member, although this toner transition is smaller in amount than the toner transition during the time period $t_1$.

Accordingly, when the applied voltage is attenuated to satisfy the relation that $$V_{max}\leqq V_D+|V_{th\cdot r}| \quad (5),$$

this process is called the third stage in the image area. Such phenomenon in the image area progresses to termination while becoming smaller in amount until the alternating component of the applied voltage becomes null and is converged to a predetermined DC value, whereupon the phenomenon reaches the state of (4).

The process of toner movement in the non-image area (potential $V_L$) of the electrostatic image bearing member will now be described by reference to FIG. 2C. In the first stage there is no toner back transition, however in the second stage shown as (2), $V_{max} > V_L > V_{min}$ and so, during the time period $t_1$ (applied voltage is $V_{min}$), a relatively weak toner transition field occurs from the toner carrier to the non-image area of the electrostatic image bearing member and the toner adheres to the non-image area. On the other hand, during the time period $t_2$ (applied voltage is $V_{max}$), a relatively strong toner back transition field occurs from the non-image area toward the toner carrier and the toner is returned from the non-image area to the toner carrier. Each time the time periods $t_1$ and $t_2$ are so repeated, the toner transition and back transition occurs between the non-image area and the toner carrier and the toner is considered to effect reciprocal movement therebetween. It is considered that the amount of toner back transition becomes greater in probability than the amount of toner transition because the relation between the applied voltages $V_{min}$ and $V_{max}$ and the non-image area potential $V_L$ is set to $$|V_{max} - V_L| > |V_L - V_{min}| \quad (6).$$

Of course, in this case, no more than the toner having adhered actually effects the back transition.

Next, when the amplitude of the applied bias voltage is continuously or intermittently attenuated to a predetermined value of $$V_{min} = V_L - |Vth \cdot f| \quad (7)$$

as shown by (3) in FIG. 2A, the amount of toner transiting from the toner carrier to the electrostatic image bearing member during the time period $t_1$ becomes substantially zero. $|Vth \cdot f|$ is the minimum absolute potential difference between the electrostatic image fromation surface and the toner carrier at which the toner can be separated from the toner carrier surface and can transit to the electrostatic image formation surface. This value is varied with the conditions of the developer and development.

Further, when $$V_{min} > V_L - |Vth \cdot f| \quad (8)$$

is reached, such transition occurs no longer and instead, there is produced an electric field which expedites the tendency of the toner to back-transit from the electrostatic image bearing member toward the toner carrier, although such back-transition is smaller in amount than the toner back transition during the time period $t_2$.

Accordingly, when the applied voltage is attenuated (in this case, $V_{min}$ is greater) to satisfy the relation that $$V_{min} \geqq V_L - |Vth \cdot f| \quad (9),$$

this process is called the third stage in the non-image area. Such phenomenon in the non-image area progresses to termination while becoming smaller in amount until the alternating component of the applied voltage becomes null and is converged to a predetermined DC value.

In other words, the fog or the phenomenon of contact of the toner with the non-image area takes place in the second stage, but it is eliminated in the second and third stages.

Description has hitherto been simply made of the extreme cases of the image area (dark area) and the non-image area (light area), but as regards the half-tone, the amount of final toner transition to the electrostatic image surface is determined by the magnitudes of the amounts of toner transition and toner back transition corresponding to the potential of the half-tone area. Therefore, the curve of the amount of toner transition for the electrostatic image potential is smaller in gradient than the curve 1 as shown by curve 3 in FIG. 1 and becomes substantially uniformly varied from the non-image area potential $V_L$ to the image area potential $V_D$. By this, there is obtained a visible image having a good tone reproduction from the light area to the dark area, including the half-tone of the image. In the second process in the above-described first method, it is essential to make such a design that the electric field alternates in the non-image area, whereby the toner once adheres to the non-image area as well, and this leads to the possibility of the toner positively adhering also to the half-tone image area having a density adjacent to the non-image area, which in turn leads to an advantage that a visible image having a good tone reproduction of such half-tone area may be obtained by effecting the strip-off (back transition) of the once deposited toner in accordance with the non-image area potential.

Figure 3A:
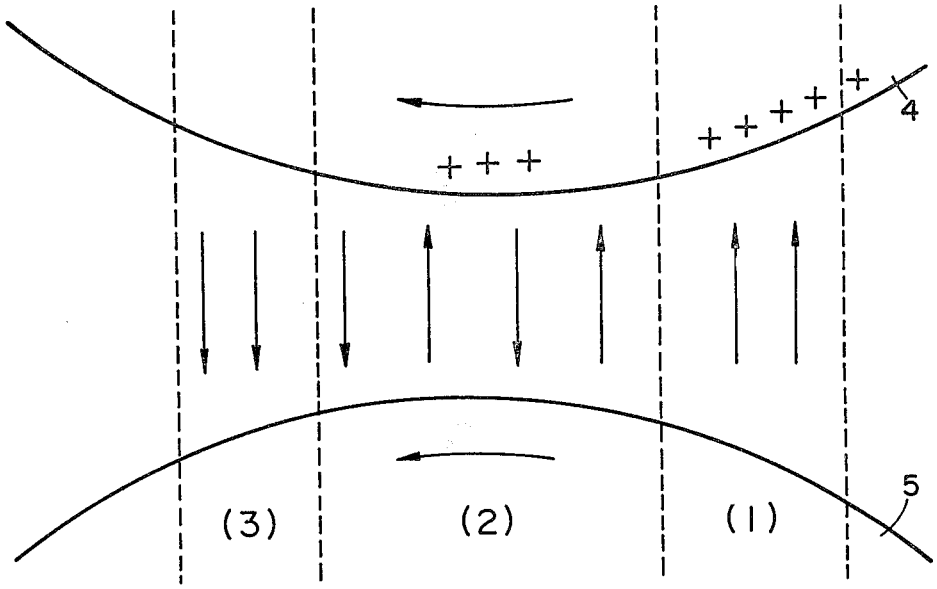
FIGS. 3A-3C illustrate another developing process of the developing method according to the present invention.
Figure 3B:
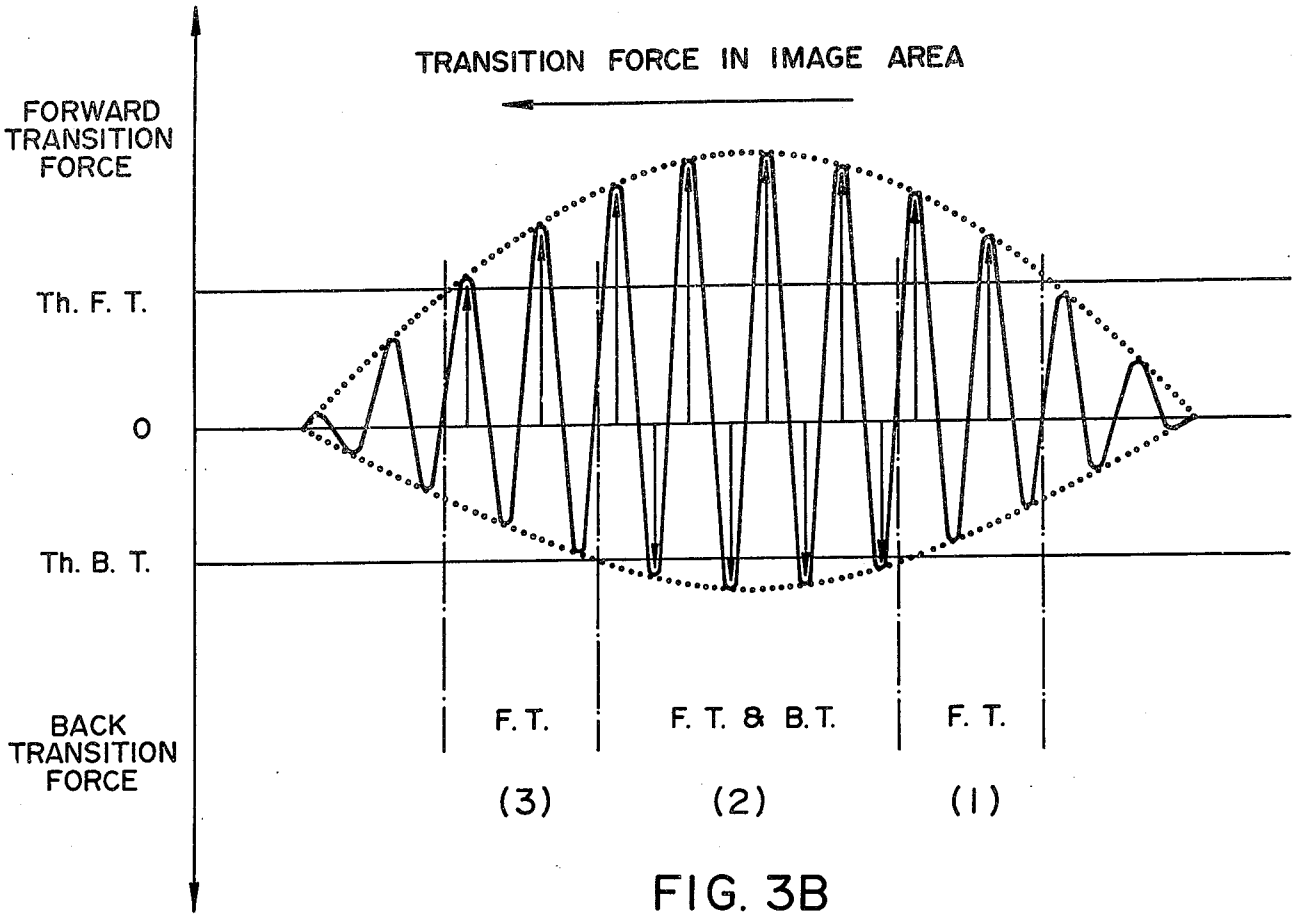
Figure 3C:
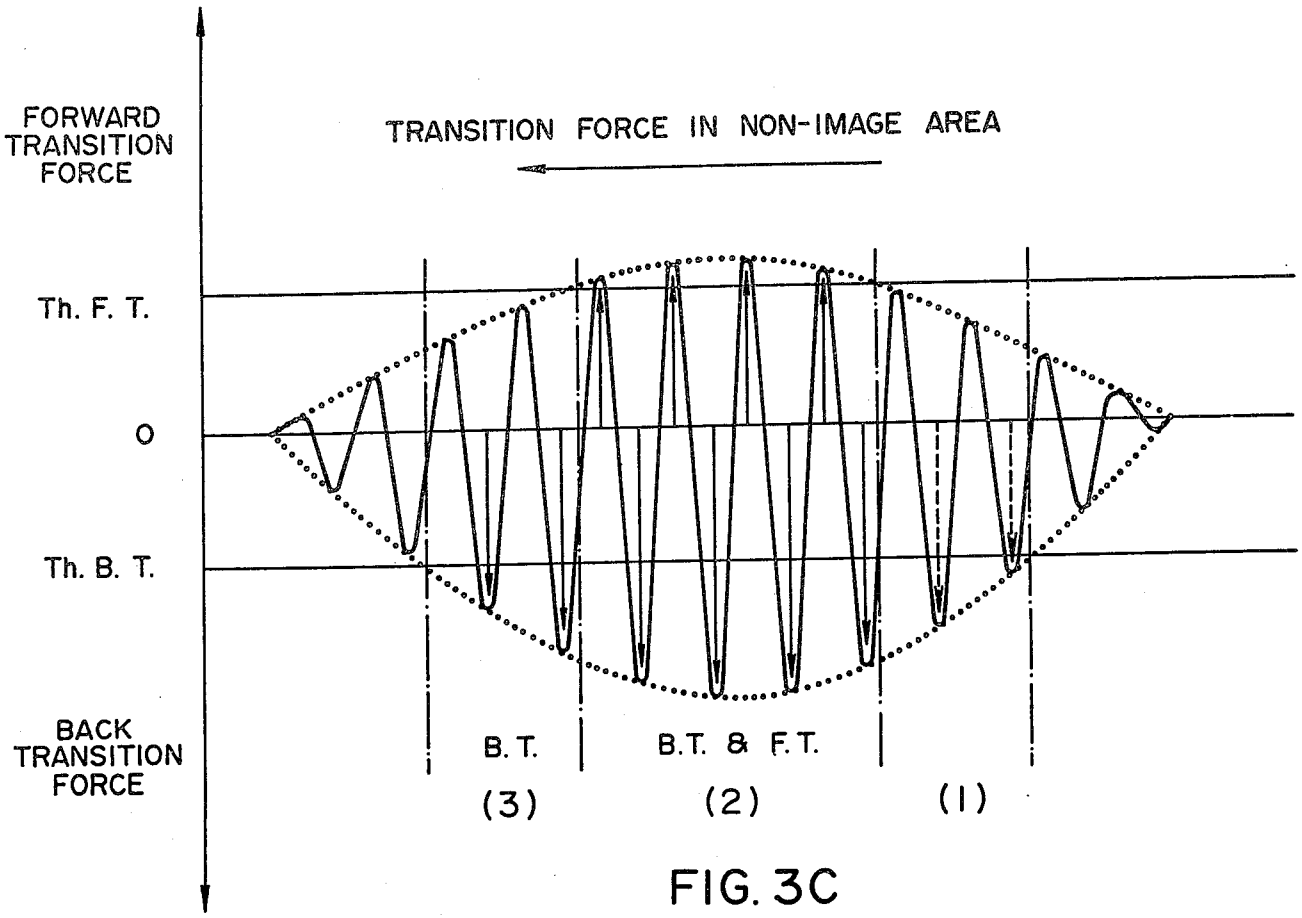

An example of the developing process in the second method is shown in FIGS. 3A, 3B and 3C. As shown in these FIG. 3B, the electrostatic image bearing member 4, such as a photosensitive drum, moves in the direction of arrow and passes through the developing area (1) and (2) to the area (3). Designated by 5 is the toner carrier, such as a sleeve. FIG. 3A shows the toner movement in each zone of stages, namely (1) Forward transition zone for the image area,
(2) Reciprocal movement zone for tone improvement, and
(3) Back transition zone for the non-image area.

FIG. 3B and 3C illustrate the function of this alternating current bias. FIG. 3B showing the toner jumping or transition force in the image area while FIG. 3C showing that in the non-image area. The abscissa represents, from the right to the left, the change in time and space. The drum and the sleeve approach each other, in the leftward direction in the drawing, and this results in a gradual increase in the toner transition force which is provided by the resultant electric field obtained from the image potential (e.g. zero because of the non-image area in case of FIG. 3C) and from the electric field (AC) caused by the bias voltage between the drum and the sleeve. At the zone (1), the transition force exceeds the forward transition threshold value, so that the toner actually transits from the sleeve toward the image area on the drum, thus starting the development. When the drum and the sleeve further approach each other, the electric field is further increased such that the backward transition threshold value (i.e. a threshold value for the back transition, toward the sleeve, of the toner which has transited to the drum under the opposite bias) is exceeded, causing the toner back transition. Thus in the zone (2), there occurs the reciprocal movement of the toner. After the drum and the sleeve pass through the nearest point, the electric field is gradually decreased so that the backward transition is terminated whereas only the forward transition is again caused to thereby complete the development.

FIG. 3C illustrates the toner transition force in the non-image area, and in this figure, the electric field is also gradually increased in the leftward direction in the drawing, such that, at first, the backward transition force exceeds its threshold value. However, there occurs no actual backward transition since no toner has been transited forwardly. Then there occur both the forward transition and backward transition, and finally, only the backward transition is caused so that all the toner particles in the non-image area return to the sleeve, thus completely eliminating the fog.

Figure 6:
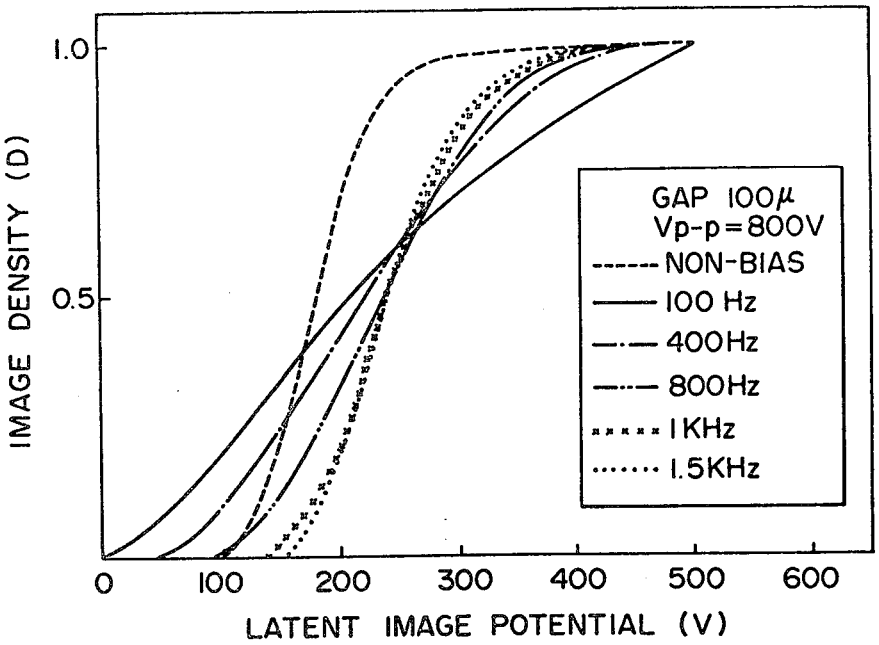
FIG. 6 shows the characteristic of the electrostatic image potential versus image density as the result of the experiment effected on the developing method according to the present invention, with the frequency of the applied alternate electric field varied.

Synthetically, in the zone (1) there occures the development of the image area; in the zone (2) there occurs the reciprocal transition in the image and non-image areas; and in the zone (3), there occurs the backward transition in the non-image area, i.e. the elimination of the fog in this area. Seemingly, the reciprocal movement in the zone (2) is worth less in both the cases of the image and the non-image areas. In fact, however, the reciprocal movement in the image area does produce an appropriate edge effect, resulting in a considerable improvement in the reproducibility of the tone part near to the non-image area. FIG. 6 is a graph showing the results. Where there is no alternating bias (broken line), the density abruptly changes with the minimum change in the electric potential, but where a bias is applied, the curve becomes small in gradient, the degree thereof being dependent on the frequency characteristics, as shown in the drawing.

Thus, again by this method, there is obtained an effect substantially equal to the effect of varying the applied bias voltage and not only the fog can be eliminated but also, as regards the half-tone, the final amount of toner transition to the electrostatic image bearing member is determined by the magnitudes of the toner transition and back transition corresponding to the surface potential of the half-tone image, with a result that the curve of the electrostatic image potential versus toner transition amount becomes one having a good tone reproduction as shown by curve 3 in FIG. 1.

The conditions that $|V_{max}-V_L|>|V_L-V_{min}|$ and $|V_{max}-V_D|<|V_D-V_{min}|$ when the image area charge is positive become $|V_{min}-V_L|>|V_L-V_{max}|$ and $|V_{min}-V_D|<|V_D-V_{max}|$ when the image area charge is negative.

As hitherto described, the application of an extraneous alternate voltage between the electrostatic image formation surface and the toner carrier remarkably improves the tone gradation of the resultant image, and it is possible to further improve the reproducibility of line images as well by selecting the amplitude and frequency of the extraneous alternate voltage to suitable magnitudes as will hereinafter be described.

Figure 4:
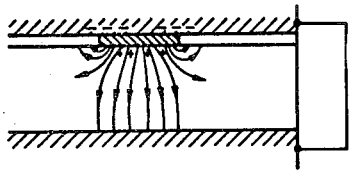
FIG. 4 PRIOR ART
FIG. 4 illustrates the electric line of force produced from the electrostatic image in the developing method according to the prior art.

Description will hereinafter be made with the electrostatic image formation charge as being positive. In the toner transfer development, as shown in FIG. 4, the electric line of force emanating from the latent image edges goes around the back electrode of the latent image formation surface and cannot reach the toner layer, thus tending to result in thinned line or poor sharpness of the edges of the image during the development.

Figure 5:
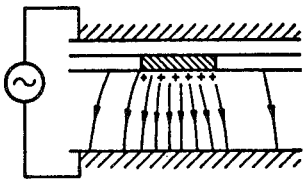
FIG. 5 illustrates the electric line of force produced from the electrostatic image in the developing method according to the present invention.

On the other hand, when the alternating wave as shown in FIG. 1 is applied and when the minimum value $V_{min}$ of the applied voltage is lower than the latent image light area potential $V_L$ as shown in this figure, the electric line of force in the developing area at the development expediting stage becomes such as shown in FIG. 5. That is, electric line of force goes less around the edges of the latent image and parallel electric fields and formed in the developing area. Thus, even the edges are developed clearly.

To enhance the reproducibility of the edges of the image in this manner, it is preferable to select the development expediting bias ($V_{min}$) to a sufficiently low value (in case of a positive electrostatic image), but too low a value for such bias would result in excessive developer adhering to the non-image area in the toner transition stage and even if the back transition bias is increased to strip off such excessive toner, the resultant image will be poor in contrast, after all.

On the other hand, in order that the toner may be separated from one of the toner carrier and the electrostatic image formation surface and transit to the other, there must be a threshold of a certain finite potential difference between the two. As such threshold value, there is $|V_{th\cdot r}|$ when the toner transition occurs from the toner carrier to the latent image formation surface as previously described, and there is $|V_{th\cdot r}|$ when the toner back transition occurs from the latent image formation surface to the toner carrier. In order to increase the reproducibility of line image while avoiding the adherence of excessive developer to the non-image area in the toner transition stage, $|V_{th\cdot f}|$ may be selected to a sufficiently great value and the development expediting bias ($V_{min}$) may be decreased. The proper value thereof substantially lies in the range $$V_L-2|V_{th\cdot f}|<V_{min}<V_L \quad (10),$$

and most preferably lies in $$V_{min}\approx V_L-|V_{th\cdot f}| \quad (11).$$

If $V_{min}$ is below $V_L-2|V_{th\cdot f}|$, the fog in the non-image area will be unavoidable.

If, in a preferred embodiment of the developing method according to the present invention, magnetic toner is used as the developer and a non-magnetic sleeve enclosing a magnet therein is used as the toner carrier, it has become apparent that there may be obtained images which are clear at the edges of the images and excellent in half-tone reproduction. An advantage of using the magnetic toner lies in that by suitably setting the magnetism of the toner and the magnetic force of the toner carrier, the binding force of the toner to the toner carrier is enhanced and accordingly, $|V_{th\cdot f}|$ becomes greater with a result that the $V_{min}$ of the extraneous alternate field can be selected to a sufficiently low value. Further, the proper value of $V_{max}$ corresponding to the proper value $$V_L-2|V_{th\cdot f}|V_{min}<V_L \text{ is } V_D<V_{max}<V_D+2|V_{th\cdot r}| \quad (12).$$

It has become clear that these values enhance the effect of improving the reproducibility to the greatest degree by a minimum alternate voltage value. To cause the toner to fly through the developing clearance and temporally reach the non-image area as well to thereby improve the tone reproduction and then to cause the toner to be stripped off chiefly from the non-image area, it is necessary to properly select the amplitude and alternating frequency of the applied alternate bias voltage. The results of the experiment in which the effect of the present invention has clearly appeared due to such selection will be shown below.

FIG. 6 shows the plotted results of an experiment in which the image reflection density (D) for the electrostatic image potential (V) is measured with the amplitude of the applied alternate voltage fixed and with the frequency thereof varied. These curves will hereinafter be referred to as the V–D curves. This experiment was carried out under the following procedure. A positive electrostatic charge latent image is formed on a cylindrical electrostatic image formation surface. The toner used is a magnetic toner which will hereinafter be described (containing 30% magnetite). The toner is applied to a thickness of about 60μ on a nonmagnetic sleeve enclosing a magnet therein, and negative charge is imparted to the toner by the friction between the toner and the sleeve surface. The result, when the minimum developing clearance between the electrostatic image formation surface and the magnetic sleeve was maintained at 100μ, is shown in FIG. 6. The density of the magnetic flux in the developing station resulting from the magnet enclosed in the sleeve is about 700 gausses. The cylindrical electrostatic image formation surface and the sleeve are rotated substantially at the same speed of about 100 mm/sec. in the same direction. Accordingly, the electrostatic image formation surface passes through the minimum clearance in the developing station, and then gradually goes away from the toner carrier. The alternate electric field applied to this sleeve is a sine wave of amplitude $V_{p\text{-}p}=800$ V (peak-to-peak value) with a DC voltage of +200 V superimposed therein. FIG. 6 shows the V–D curves when the alternating frequency of the applied voltage is 100 Hz, 400 Hz, 800 Hz, 1 KHz and 1.5 KHz, and the V–D curves when no bias field is applied but the back electrode of the electrostatic image formation surface and the sleeve are made to conduct.

From these results, it is seen that when no bias field is applied, the gradient on the so-called γ value of the V–D curves is very great but by an alternate electric field of low frequency being applied, the γ value becomes very small to greatly enhance the tone gradation. As the frequency of the extraneous electric field is increased from 100 Hz, the γ value gradually becomes greater and the effect of enhancing the tone gradation becomes poorer and in the case of a clearance of 100μ, the effect becomes very weak under the aforementioned amplitude ($V_{p\text{-}p}=800$ V) when the frequency exceeds 1.5 KHz. This is considered attributable to the following reason. A finite time is necessary to ensure reciprocal movement of the toner when the toner repeats its adherence and separation in the clearance between the sleeve surface and the latent image formation surface during the developing process in which an alternate electric field is applied. Particularly, when the toner transits by being subjected to a weak electric field, it takes a long time for the toner to positively effect its transition. On the other hand, to reproduce the density of half-tone, it is necessary for the toner subjected to an electric field which is weak but greater than a certain threshold value to positively transit to the image area within one-half of the period of the alternate electric field. For that purpose, a lower frequency is more advantageous if the amplitude of the alternate electric field is constant, and thus, especially good tone reproduction may be obtained for an alternate electric field of very low frequency as represented by the results of the experiment.

On the other hand, too low a frequency would not result in sufficient repetition of the reciprocating movement of the toner during the time the latent image formation surface passes through the developing station, and tends to cause irregular development to be created in the image by the alternate voltage. As the result of the foregoing experiment, generally good images have been provided down to the frequency of 40 Hz, and when the frequency is below 40 Hz, irregularity has been created in the visible image. It has been found that the lower limit of the frequency for which no irregularity is created in the visible image depends on the developing conditions, above all, the developing speed (also referred to as the process speed, $V_p$ mm/sec.). In the present experiment, the velocity of movement of the electrostatic image formation surface has been 110 mm/sec. and therefore, the lower limit of the frequency is $$40/110\times V_p \approx 0.3\times V_p \quad (13).$$

As regards the waveform of the alternate voltage applied, it has been confirmed that any of sine wave, rectangular wave, saw-tooth wave or asymmetric wave of these is effective.

Such application of an alternate bias of low frequency brings about remarkable enhancement of the tone gradation, but the voltage value thereof must be properly set. That is, too great a value for the $|V_{min}|$ of the alternate bias may result in an excessive amount of toner contacting the non-image area during the toner transition stage and this may prevent sufficient removal of such toner in the second process of the development, which may in turn lead to fog or stain left in the image. Also, too great a value for $|V_{max}|$ would cause a great amount of toner to be returned from the image area, thus reducing the density of the so-called solid black portion. To prevent these phenomena and to sufficiently enhance the tone gradation, $V_{max}$ and $V_{min}$ may preferably and reasonably be selected to the following degrees:

$$V_{max} \approx V_D + |Vth\cdot r| \quad (14)$$

$$V_{min} \approx V_L - |Vth\cdot f| \quad (15)$$

Vth·f and Vth·r are the potential threshold values already described. If the voltage values of the alternate bias are so selected, the excess amount of toner adhering to the non-image area in the toner transition stage and the excessive amount of toner returned from the image area in the back transition stage would be prevented to ensure realization of proper development result.

As described above, the method of the present invention includes a process, as the first stage, in which the alternating electric field is so adjusted as to produce the transition of the developer particles one-sidedly from the developer carrier to the image area on the electrostatic image bearing member. By the provision of such process, the density in the image area is sufficiently increased, while the tone reproducibility and the line image reproducibility are actually improved, as well.

Description will now be made of such pre-process with reference to the above-noted figures.

Referring again to FIGS. 2A and 3A, a bias voltage satisfying a similar relation as in the third stage, i.e., $$V_{max} \leqq V_D + |V_{th \cdot r}| \quad (5)'$$

is applied prior to the second and third stages (2) and (3). This provides the process in which there occurs transition of the developer particles from the developer carrier to image area on the electrostatic image bearing member but in which there occurs no back transition. In this case, if in the non-image area, $$V_{min} > V_L - |V_{th \cdot f}| \quad (8)'$$

is satisfied, it is possible to prevent the transition (namely, since no transition has occurred, the back transition would not occur even if the electric field satisfies the conditions).

Such pre-stage in which only the transition occurs in the image area can be established by regularly applying such alternating electric field as in the stage (3), or by applying an electric field which varies in such manner as in the successive stages (1), (2) and (3). As a particular method therefor, the alternating voltage is gradually increased, or alternatively, the developing clearance is gradually decreased under a constant alternating electric field, the principles having already been described hereinabove.

Seemingly, this first stage is not advantageous since in the succeeding second stage the developer particles adhered to the image area again move reciprocally. In fact, however, this first stage is effective to increase the possibility of the transition in the image area to thereby increase the effective developing time, thus increasing the density in the image area. Further, during this period, the above advantages can be provided without adversely affecting the non-image area (i.e. fog) under the condition represented by the equation (8)'. Thus the first stage is of great advantage in a practical sence.

Some specific examples will be shown below in detail.

EXAMPLE 1

Figure 7A:
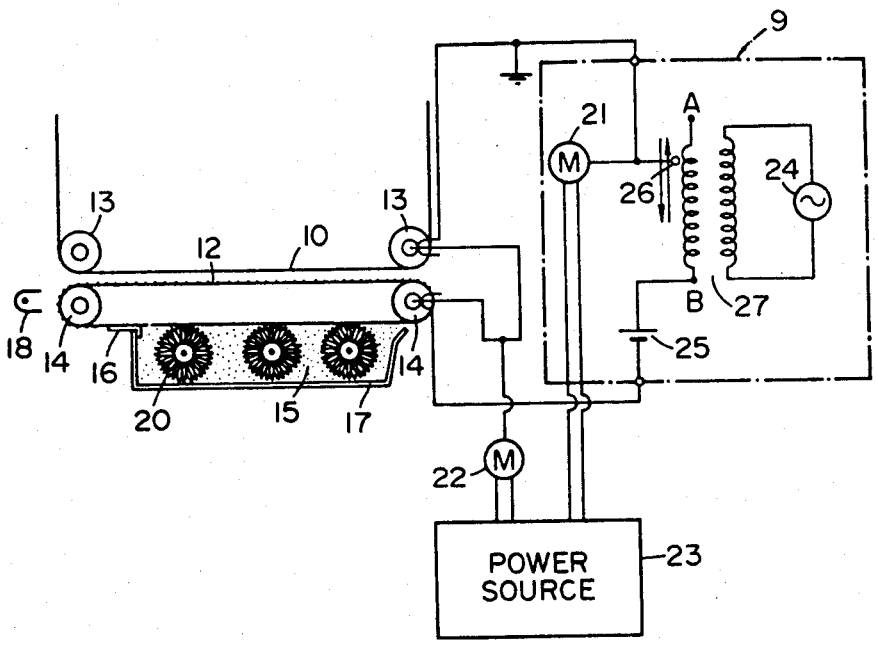
FIGS. 7A, 7B, 8 and 9A illustrate the developing method according to the present invention and embodiments of the apparatus therefor.
Figure 7B:
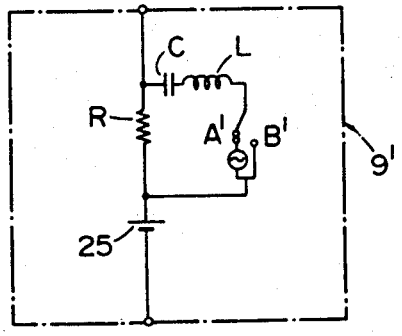

The example shown in FIG. 7A is of a construction in which the applied bias alternate voltage is increased and then attenuated, and shows a mode in which a source voltage comprising an AC voltage of low frequency with a DC component superimposed thereon is attenuated by the use of a mechanical sliding electrode. FIG. 7B shows a modified portion for attenuating the voltage by the use of an electric circuit.

In FIG. 7A, reference numeral 10 designates ZnO photosensitive paper which has formed thereon an electrostatic image at another station, not shown. The paper 10 is conveyed to the shown developing station by a pair of rollers 13,13 and stopped there for development, and then again conveyed for fixation. Designated by 12 is a toner carrier comprising an electrically conductive rubber belt and driven by a pair of metal rollers 14,14. The ZnO photosensitive paper 10 as the electrostatic image bearing member and the toner carrier 12 are transported to the developing station by the rollers 13 and 14 being intermittently driven by motors 21 and 22, and become stationary during the developing process, and shift before the next developing cycle is started. The toner carrier effect one-half of a full rotation and is stopped again. Denoted by 15 is an insulating toner contained in a container 7 and it comprises styrene resin, 3% carbon black and 2% positive polarity charge control agent, all by weight. Also, to improve the fluidity, 0.2% by weight of colloidal silica is extraneously added. The toner is conveyed by the toner carrier 12, and the thickness of the toner applied is controlled to 100 to 200$\mu$ by a member 16 slidably contacting the carrier 12, and positive charge is imparted to the toner by a corona charger 18 before development is started. The clearance between the electrostatic image bearing 10 and the toner carrier 12 is maintained at 500$\mu$. Designated by **14*a* is a slidable electrode which is in contact with the core of the rotary roller 12, and which applies an alternate voltage to the toner carrier 12 from a power source 9. Denoted by 20 is a fur brush for stirring the developer to supply it to the toner carrier 12**.

The dark region potential of the electrostatic image formed on the electrostatic image bearing member 10 was −450 V and the light region potential of such image was −40 V. The voltage applied comprised an AC voltage 1200 $V_{pp}$ of frequency ranging from 10-1000 Hz, with a DC voltage of −200 V superimposed thereon, and only the AC voltage is attenuated to 0 at a time constant of about 0.5 in 0.2 second after the start of the development.

Description will now be made of the construction of the power source 9 for causing such attenuation. Reference numeral 21 designates a motor for moving the sliding electrode 26 on the secondary winding side of an AC transformer 27. Reference numeral 24 designates an AC power source, and 25 a DC power source. Designated by 23 is a power source for driving a timing signal generating circuit and motors 21, 22.

In 0.2 second after the start of the development, the sliding electrode 26 moves from its position A to its position B at a uniform velocity after 0.5 second. Upon displacement of the sliding electrode 26 to its position B, the motor 22 is driven to cause the toner carrier 12 to effect one-half of a full rotation and during this time, the sliding electrode returns to its position A.

The reflecting density in resultant image area was 1.1. Next, another electrostatic image having the same conditions was set, and only the condition for the applying alternating current bias was changed. In that situation, the sliding electrode was moved, for one second, from its position B to its position A at a constant speed, and then after 0.2 second, the sliding electrode was moved, for 0.5 second, from its position A to its position B. That is, what is different from the preceding operation is only the addition the movement from B to A position, as the pre-stage. The reflecting density of in resultant image area was 1.4. The non-image areas of those two images had substantially no fog, and the gradation of each image was excellent.

FIG. 7B shows a power source 9' using a well-known RLC attenuating circuit instead of using a sliding electrode.

EXAMPLE 2

Figure 8:
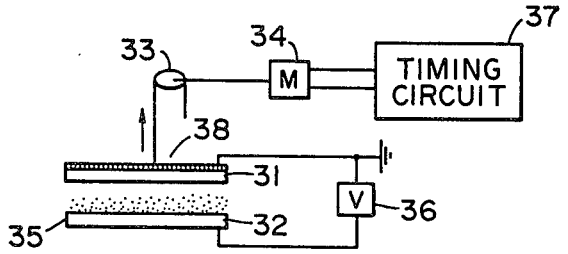

This example exemplarily shows the developing method in accordance with the second method as described hereinbefore. Referring to FIG. 8, the reference numeral 31 designates an electrostatic image bearing member having an insulating layer on a CdS photoconductive layer. Reference numeral 32 designates an electrically-conductive-developer carrying member, and reference numeral 36 designates a power source for applying a low frequency AC voltage to the toner carrier. Reference numeral 34 designates a motor for driving through a roller 34 the electrostatic image bearing member 31 so as to move it away from the toner carrier, the drive of the motor being controlled by a timing circuit 37.

The electrostatic image bearing member 31 and the toner carrier 32 are initially so maintained that a clearance of 300μ to 500μ in width is interposed therebetween. Then, after 0.2 second, the electrostatic image bearing member 31 is lifted by the motor 34 at a constant speed, for 0.2 second and until the clearance is increased to 1 mm in width. At this point, the development is completed. During this process, the image area of the electrostatic image which has been charged positively (+350 V) is developed by the developer 35 charged negatively. The components of this negatively charged toner are the same as that in the other examples.

Between a back electrode 38 of the electrostatic image bearing member 31 and the toner carrier 32, an extraneous alternating voltage is applied, and in this example, as described in detail with reference to FIG. 3, $V_{max}$ was 500 V, $V_{min}$ was −300 V and the alternating frequency f was 50 Hz. In such case, the maximum potential in the image area, i.e. $V_D$, was +350 V whereas the non-image area potential $V_L$ was −50 V. Thus, according to the developing process as described with reference to FIG. 3, there was obtained an image having no fog but having excellent gradation in which the image area dencity was 1.2.

Next, another electrostatic image having the same conditions was subjected to the development. The clearance was initially maintained at 1 mm width, for 0.2 second. Then the clearance was decreased to 300–500μ width, and after 0.2 second, the electrostatic image bearing member and the toner carrier were again relatively moved away from each other at a constant speed, for 1 second, to increase the clearance to 1 mm width. During that movement, the above-described alternating voltage was applied.

The resultant image was excellent in density as compared with the image obtained by the process described just above.

EXAMPLE 3

Figure 9A:
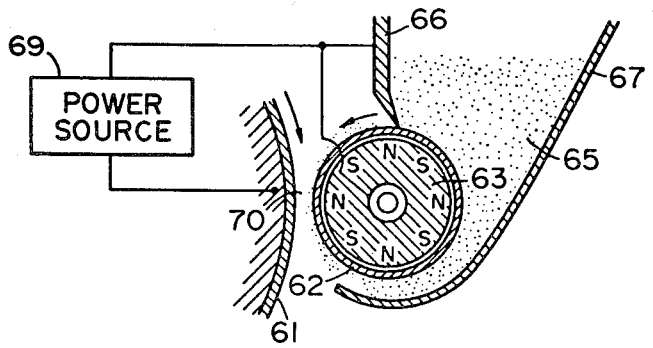
Figure 9B:
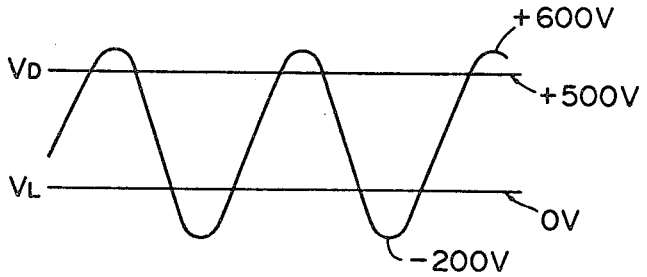
FIG. 9B illustrates the voltage waveform applied to the apparatus shown in FIG. 9A.

Referring to FIG. 9A, reference character 61 designates a photosensitive drum having a radius of 40 mm and having a CdS layer and an insulating layer. Designated by 62 is a non-magnetic sleeve having a radius of 15 mm and enclosing a permanent magnet 63 therein. The members 61 and 62 are rotated at the same peripheral velocity of 100 mm/sec. in the same direction. Denoted by 65 is an insulative magnetic toner which comprises 60% by weight of styrene resin, 35% by weight of magnetite, 3% by weight of carbon black and 2% by weight of negative charge control agent. To improve the fluidity of the toner, 0.3% by weight of colloidal silica is extraneously added. The toner is conveyed by the sleeve 62, and the thickness of the toner applied onto the sleeve is controlled to about 70μ by a magnetic blade 66 disposed in proximity to the sleeve. Also, a negative charge is imparted to the toner by the friction charging between the toner and the sleeve 62. The clearance between the members 61 and 62 is maintained at a minimum of 200μ, but the movement velocities of and the clearance between the two members are set so as to satisfy the conditions already described with respect to FIGS. 3A, 3B and 3C, with the rotation of the members 61 and 62. The members 62 and 66 are kept electrically conductive, and an alternate voltage is applied to the electrically conductive support member of the member 61 by a power source 69. The alternate voltage is a sine wave having a frequency of 200 Hz and the relation between the voltage value and the electrostatic image potential is such as shown in FIG. 9B.

The electrostatic image potential is 500 V for the image area and 0 V for the non-image area, and is a sine wave of amplitude 400 V (800 $V_{pp}$) with DC voltage of +200 V superimposed thereon. Under the above-described construction and by the low frequency based on the developing action fully described with respect to FIGS. 3A, 3B and 3C, there have been obtained images which are high in tone gradation and clear.

As has been described in detail, the present invention provides a developing method in which an electrostatic image bearing member having a back electrode is opposed to a toner carrier with a predetermined fine clearance maintained therebetween, the method including the following three stages as an essential feature of the present invention:

first stage: an alternating electric field which is weaker than that in the succeeding stage is applied so as to produce, in the clearance between the image area and the toner carrier at the developing station, the toner transition one-sidedly from the toner carrier to the image area;

second stage: a low frequency alternating electric field is applied in order that, in the clearance between the non-image area and the toner carrier and in the clearance between the image area and the toner carrier, at the developing station, the transition of the toner particles and the back transition toward the toner carrier are alternatively repeated in both the non-image area and the image area; and third stage: subsequent to the second stage, a low frequency alternating electric field having an intensity different from that in the above stage is applied so as to produce, in the clearance between the toner carrier and the image area, the toner transition one-sidedly from the toner carrier to the image area and also to produce, in the clearance between the toner carrier and the non-image area, the toner back transition one-sidedly from the non-image area to the toner carrier.

The method of the present invention, including these stages, provides such visualized images as having various advantages mentioned below.

In the second and third stages, as described above, the toner adhered to the non-image area returns to the toner carrier so that the toner adherence to the non-image area is completely avoided, whereas the toner is expedited to adhere to the image area so that the toner adherence to the image area becomes satisfactory. Therefore, the reproduced images have excellent gradation without any fog, and the reproduction itself is faithful to the original.

The foregoing description has been made with respect to a case where the image area potential $V_D$ is positive, whereas the invention is not restricted to such case but the invention is also applicable to a case where the image area potential is negative, and in that case, equations (2)–(12) previously mentioned may be expressed as follows:

$$|V_{min}-V_D| < |V_D-V_{max}| \quad (2')$$

$$V_{min}=V_D-|V_{th}\cdot r| \quad (3')$$

$$V_{min} > V_D - |V_{th \cdot r}| \quad (4')$$

$$V_{min} \geqq V_D - |V_{th \cdot r}| \quad (5')$$

$$|V_{min} - V_L| > |V_L - V_{max}| \quad (6')$$

$$V_{max} = V_L + |V_{th \cdot f}| \quad (7')$$

$$V_{max} < V_L + |V_{th \cdot f}| \quad (8')$$

$$V_{max} \leqq V_L + |V_{th \cdot f}| \quad (9')$$

$$V_L < V_{max} < V_L + 2|V_{th \cdot f}| \quad (10')$$

$$V_{max} \approx V_L + |V_{th \cdot f}| \quad (11')$$

$$V_D - 2|V_{th \cdot r}| < V_{min} < V_d \quad (12')$$

The present invention is not restricted to the above-described embodiments, but is applicable to the development of images formed by the electrophotographic method, the electrostatic recording method and other image formation methods.

What we claim is:

1. A dry developing method for applying a layer of one-component developer to a latent image, said method comprising the steps of:

establishing a development zone between an electrostatic latent image bearing member and a developer carrying member, said zone being wider than the thickness of the layer of one-component developer on said carrying member;

introducing an alternating electric field into said development zone; and varying said alternating electric field with progress of development to define three different stages of said field, each of which causes different movement of developer particles in said development zone, wherein during the second stage developer particles reciprocate between said image bearing member and said developer carrying member.

2. The developing method according to claim 1, wherein said electrostatic image bearing member and said developer carrier member are stationary and opposed to each other and the amplitude of said alternating electric field is increased and then attenuated toward the termination of the development and converged into a predetermined value.

3. The developing method according to claim 1, wherein said alternating electric field is maintained constant, and said electrostatic image bearing member and said developer carrying member are opposed to each other while being moved to decrease and then increase the clearance between gradually, to thereby impart said first through third stages.

4. The developing method according to claim 1, wherein the frequency of said alternating electric field is 1.5 KHz or lower.

5. The developing method according to claim 1, satisfying the following relationships:

$$0.3 \times V_p < f < 1500 \text{ (Hz)}$$

where $V_p$ (mm/sec.) represents the velocity of movement of said electrostatic image bearing member and f (hz) represents the frequency of said alternating electric field.

6. The developing method according to claim 1, satisfying the following relationships when the image potential is positive $$|V_{max} - V_L| > |V_L - V_{min}|$$

$$|V_{max} - V_D| < |V_D - V_{min}|$$

or when the image area potential is negative $$|V_{min} - V_L| > |V_L - V_{max}|$$

$$|V_{min} - V_D| < |V_D - V_{max}|$$

where $V_{max}$ and $V_{min}$ respectively represent the minimum value and minimum value of the alternating voltage of the developer carrying member with a back electrode of the electrostatic image bearing member as the standard, $V_D$ represents the image area potential and $V_L$ represents the non-image area potential.

7. The developing method according to claim 1, satisfying the following relationships when the image area charge is positive $$V_L - 2|V_{th \cdot f}| < V_{min} < V_L$$

or when the image area charge is negative $$V_L < V_{max} < V_L + 2|V_{th \cdot f}|$$

wherein $V_{max}$ and $V_{min}$ respectively represent the maximum value and the minimum value of the alternating voltage of said developer carrying member with the back electrode of said electrostatic image bearing member as the standard, $V_D$ represents the image area potential, $V_L$ represents the non-image area potential, and $|V_{th \cdot f}|$ represents the minimum absolute potential between the surface of said electrostatic image bearing member and the surface of said developer carrying member whereat said developer is separated from said developer carrier surface and can effect transition to said electrostatic image bearing surface.

8. The developing method according to claim 1, satisfying the following relationships when the image area charge is positive $$V_D < V_{max} < V_D + 2|V_{th \cdot r}|$$

or when the image area charge is negative $$V_D - 2|V_{th \cdot r}| < V_{min} < V_D$$

where $|V_{th \cdot r}|$ represents the minimum absolute potential difference between the surface of said electrostatic image bearing member and the surface of said developer carrying member whereat said developer is separated from said electrostatic image bearing surface and can effect back transition to said developer carrying member.

9. The developing method according to claim 7, wherein said $|V_{th \cdot f}|$ is imparted by using a magnetic one-component toner as the developer and using a developer carrying member having a magnetic binding force.

10. The developing method according to claim 1, wherein said electrostatic image bearing member is in the form of a drum, said developer carrying member is a rotating member, and said electrostatic image bearing member and said developer carrying member are arranged to define a variable clearance therebetween, whereby the intensity of said alternating electric field in said clearance is varied.

11. The developing method according to claim 1, wherein if the developing clearance is d, the combination of the amplitude and frequency of said alternate electric field is a combination of relatively high $V_{p-p}$ and relatively high f when d is great.

12. A dry developing method for applying a layer of one-component developer to a latent image, said method comprising the steps of:

establishing a development zone with an air gap defined between an electrostatic latent image bearing member and a developer carrying member, said gap being wider than the thickness of the layer of developer on said carrier member;

establishing a first alternating electric current bias field at a first stage in said development zone to produce one-sided movement of developer particles from the developer carrying member to the latent image bearing member;

establishing a second alternating electric current bias field at a second stage in said development zone to produce reciprocal movement of the developer particles between the latent image bearing member and the developer carrying member; and establishing a third alternating electric current bias field at a third stage in said development zone to produce one-sided movement of the developer particles from the non-image area to the developer carrying member.

13. A developing device for applying a layer of one-component developer to a latent image comprising an electrostatic image bearing member, a developer carrier carrying one-component developer thereon, means for disposing said image bearing member and said developer carrier in opposed relationship in a developing station with a clearance therebetween to form a development zone wider than the layer of developer, means for applying an alternating field to said developing clearance, means for varying said alternating field in order to produce three stages of a bias field, each of which causes different movement of developer particles in said development zone, wherein during the second stage developer particles reciprocate between said image bearing member and said developer carrying member.

* * * * *

UNITED STATES PATENT AND TRADEMARK OFFICE

CERTIFICATE OF CORRECTION

PATENT NO. : 4,473,627

DATED : September 25, 1984

INVENTOR(S) : Junichiro Kanbe et al.

It is certified that error appears in the above-identified patent and that said Letters Patent is hereby corrected as shown below:

The term of this patent subsequent to September 29, 1998, has been disclaimed.

Signed and Sealed this

*Fifth* Day of *February 1985*

[SEAL]

*Attest:*

DONALD J. QUIGG

*Attesting Officer* *Acting Commissioner of Patents and Trademarks*

UNITED STATES PATENT AND TRADEMARK OFFICE

CERTIFICATE OF CORRECTION

PATENT NO. : 4,473,627

DATED : September 25, 1984

INVENTOR(S) : JUNICHIRO KANBE, ET AL.

It is certified that error appears in the above-identified patent and that said Letters Patent is hereby corrected as shown below:

Column 1, line 17, "therefore" should read --therefor--;
line 44, "bacground" should read --background--.

Column 3, line 43, "therefore" should read --therefor--;
line 62, "therefore" should read --therefor--.

Column 4, line 44, "therefore" should read --therefor--;
line 56, "therefore" should read --therefor--

Column 5, line 23, "described" should read --describe--.

Column 6, line 66, "oppsite" should read --opposite--;
line 68, "have" should read --has--.

Column 7, line 54, "lenght" should read --length--.

Column 8, line 3, "plase" should read --place--;
line 43, "have" should read --has--

Column 9, lines 40,41, "fromation" should read --formation--.

Column 11,line 14, "occures" should read --occurs--.

Column 12,line 64, insert --as-- after "well".

Column 15,line 65, "effect" should read --effects--.

Column 16,line 9, insert --member-- before "10";
line 49, insert --of-- after "addition";
line 50, "in" should read --the--.

Column 17,line 29, "dencity" should read --density--.

UNITED STATES PATENT AND TRADEMARK OFFICE

CERTIFICATE OF CORRECTION

PATENT NO. : 4,473,627

DATED : September 25, 1984

INVENTOR(S) : JUNICHIRO KANBE, ET AL.

It is certified that error appears in the above-identified patent and that said Letters Patent is hereby corrected as shown below:

Column 20, lines 11,12, Claim 6, "minimum" should read --maximum--.

Signed and Sealed this

*Eighteenth* Day of *February 1986*

[SEAL]

*Attest:*

DONALD J. QUIGG

*Attesting Officer*

*Commissioner of Patents and Trademarks*